US006679817B1

(12) United States Patent
Williams

(10) Patent No.: US 6,679,817 B1
(45) Date of Patent: Jan. 20, 2004

(54) LOWER BODY EXERCISE DEVICE AND METHOD

(76) Inventor: Mary S. R. Williams, 2821 E. Helen St., Tucson, AZ (US) 85716

( * ) Notice: Subject to any disclaimer, the term of this patent is extended or adjusted under 35 U.S.C. 154(b) by 23 days.

(21) Appl. No.: 09/991,618

(22) Filed: Nov. 5, 2001

Related U.S. Application Data

(60) Provisional application No. 60/322,298, filed on Sep. 11, 2001, provisional application No. 60/298,215, filed on Jun. 12, 2001, provisional application No. 60/275,226, filed on Mar. 11, 2001, provisional application No. 60/266,896, filed on Feb. 6, 2001, provisional application No. 60/262,700, filed on Jan. 20, 2001, and provisional application No. 60/260,001, filed on Jan. 6, 2001.

(51) Int. Cl.[7] ..... A63B 26/00; A63B 71/00

(52) U.S. Cl. ..... 482/140; 482/142; 446/220

(58) Field of Search ..... 982/140, 142, 982/148; 5/716, 719, 718, 731, 740; 446/220

(56) References Cited

U.S. PATENT DOCUMENTS 5,647,829 A * 7/1997 Rivas ..... 482/142

* cited by examiner

*Primary Examiner*—Nicholas D. Lucchesi
*Assistant Examiner*—L. Amerson
(74) *Attorney, Agent, or Firm*—Gavin J. Milczarek-Desai; Durando Birdwell & Janke

(57) ABSTRACT

Abstract A lower-body exercising device and method including a three-dimensional platform with a resilient means for providing a resistance-based workout while sitting at work, home or traveling is disclosed. Preferably, the invention is manufactured from a single piece of material, is designed to be wedge-like in shape, is compact in size so as to fit under a desk or table or airplane seat, and is constructed from polyurethane foam that provides resistance to a pushing force by the user during manipulation. The invention can be manipulated by pressing the soles of the feet alternately into the device, or together in a "pumping" motion. Optionally, the device is covered it in a plush, washable upholstery material, has textured s, and/or includes heating elements.

8 Claims, 5 Drawing Sheets

LOWER BODY EXERCISE DEVICE AND METHOD

STATEMENT OF RELATED APPLICATIONS

This application is based on the following U.S. Provisional Patent Applications: Ser. No. 60/260,001 filed Jan. 6, 2001; Ser. No. 60/262,700 filed Jan. 20, 2001; Ser. No. 60/266,896 filed Feb. 6, 2001; Ser. No. 60/275,226 filed Mar. 11, 2001; Ser. No. 60/298,215 filed Jun. 12, 2001; and Ser. No. 60/322,298 filed Sep. 11, 2001. The contents of these applications are hereby incorporated herein by reference.

BACKGROUND

1. Field of the Invention

The invention relates in general to exercise methods and fitness equipment and more particularly to an exercising device and method that improves the circulation and lower body muscle tone of those who spend prolonged periods sitting or in other sedentary situations, 2. Description of the Related Art Portable lower body exercising devices are desirable for use while sedentary for prolonged periods during work or travel. However, those which have been developed suffer from one or more drawbacks, including weight, complexity, bulkiness, awkward operation, noise, and lack of appeal to the eye or touch.

U.S. Pat. No. 5,267,923 by Piaget et al discloses a foot treadle operated by a bellows system, transferring air from one bellows to the other when the feet perform a riding, jogging or climbing action.

U.S. Pat. No. 6,042,521 issued to De Giorgis discloses a device consisting of two oval shaped footrests, which pivot on a beam by means of ball and socket fittings. The feet can be tilted from side-to-side and also up and down alternately.

U.S. Pat. No. 6,217,488 by Bernardson discloses a rocking type foot and lower leg exerciser incorporating 1 or 2 centrally pivoted pedals mounted upon a base. The pivot point is located longitudinally.

U.S. Pat. No. 5,201,568 issued to Christensen et al discloses a rigidly constructed adjustable footrest. It consists of an elliptically shaped footpad that is kept in place by a ratchet mechanism, restricting movement of the legs to provide support.

U.S. Pat. No. 5 5577, 806 issued to Ugalde discloses a rigidly constructed adjustable footrest. The footpad is adjustable and is fixed to a specific position.

While these related-art devices simulate a range of actions with the fee e.g. rocking, riding, jogging or climbing, they require, among other things, significant space and/or produce noise from air movements or pedals. Therefore, such devices are unsuitable for use in a quiet office or under the seat on an airplane.

Recently, the need for lower body exercisers that are simple and convenient for travelers to use has been highlighted by the news media. Passenger and airline staff are subject to prolonged hours of sitting during long distance travel, characterized as greater than 3–4 hours of travel time. When travelers are seated for such periods of time, there is pooling of the blood in the deep veins of the lower limbs, due to lack of body movement or restriction of venous flow, which results in poor circulation and swelling of the legs. There is also an increased risk of the development of deep vein thrombosis (DVT) or the formation of blood clots (embolisms) that can result in death if left untreated. Airline doctors have been aware for over 60 years of a condition known as the "economy class syndrome" which is given to describe the dangers of prolonged immobility. In fact, a research study has shown that pulmonary embolism was the second leading cause (18%) of in-flight and post-flight death at London Heathrow between 1979 and 1983, with 81% of the cases being women (Sarvesvaran R (1986) *Sudden natural deaths associated with commercial air travel. Med Sci. Law*, 26, 35–8).

Recently published personal accounts have also highlighted this problem. A 29 yr-old journalist, who developed DVT after lying for 23 hours from Australia to the UK, reported his harrowing experience in the Nov. 29, 2000 issue of the London Times, titled "The Blood Clot that Changed my Life." Fortunately, he was diagnosed promptly on arriving in London and was able to receive immediate treatment for his embolism. However, in September of that same year the embolism-related death of a young 28 yr-old woman flying the London-Sydney route shocked the public and raised passenger anxiety of flying economy class on long-haul flights. The American Heart Association states that 1 in 10 patients who develop an embolism will die without prompt treatment. Many others suffer a stroke, which can result in brain damage. The Jun. 27, 2001 issue of the Wall Street Journal, titled "Fear of Flying" featured a detailed front-page article of the problem of DVT and the economy class syndrome and the slow response of the US.

Another research study by a UK medical research group reported that symptomless DVT might occur in as many as 10% of long-haul travelers. See Scurr et al (2001) *Frequency and prevention of symptomless deep-vein thrombosis in long-haul flights*: a randomised trial The Lancet, 357, 1485–1489. They also concluded that it is the prolonged, inactive sitting, and not the confined space, which is most likely to promote the DVT. Furthermore, similar situations, such as sitting at a desk or computer may also produce DVT. Landgraf et al 1994 suggest that the edema or swelling of the legs that develops during prolonged inactivity is probably caused by the compressing of the deep popliteal vein at the back of the knees at the edge of the seat during sitting (Landgraf H. et al (1994) *Economy class some: Rheology, fluid balance, and lower leg edema during simulated 12-hour long distance flight*. Aviation, Space and Environmental Medicine, October, 930–935).

Thus, office workers and others who remain seated for long periods at a desk or computer may develop DVT or other related vascular conditions, including stroke. Typically, office workers can spend 20 hours or more per week at their computers. Poor circulation in the lower limbs can result in decreased blood supply to muscles and organs producing fatigue and a predisposition to muscle injury (Canadian Center for Occupational Health and Safety, June 1998). Exercising the lower limbs while sitting at a desk or computer with a simple exercise device can tone and improve the circulation, as well as improve posture and work ergonomics. This may reduce employee sick days and worker's comp expenses related to musculoskeletal problems such as lower back pain and tendinitis. The Canadian Center for Occupational Health and Safety (June 1998) recommend that employees should exercise vigorously by walking or other exercise for 5 minutes for every 40–50 minutes of sitting to avoid swollen legs. US Physicians from the HealthBeat website recommend that office workers who sit should move around about every 30 minutes to improve blood circulation and loosen muscles.

It may not be easy for employees to move about every half hour to hour by virtue of their job design or location. Though there are office exercises that have been designed, for example, stretching exercises produced by UCLA Ergonomics, these involve dedicating time away from the desk or chair that again may not be easily available to many employees and travelers.

Such employees would benefit from the capability to exercise the lower limbs to promote circulation while sitting Exercising the lower limbs while sitting at a desk or computer with a simple exercise device can tone and improve the circulation, as well as improve posture and work ergonomics, This may reduce employee sick days and worker's comp expenses related to skeletal problems such as lower back pain and tendinitis.

To date, there are no satisfactory (i.e. portable, compact, inexpensive, easy-to-use, silent, appealing to the eye, etc.) lower-body exercising devices that can be used by travelers, airline employees, office workers, "couch potatoes" and others who would benefit from improved circulation, muscle toning, and lower limb exercising while having to be confined to a seat. Thus, there remains a need in the art for an improved exercise device and method.

SUMMARY OF THE INVENTION

The invention relates in general to a device and method for exercise that includes a one piece, three-dimensional platform of material adapted for exercising the lower body of a sedentary person through a resilient means for providing resistance. The invention possesses many advantages over the related-art devices in that it is portable, small and lightweight, silent during operation, simple in design, inexpensive to construct, and easy to manipulate with the feet during periods of physical inactivity, such as when sitting at a desk or in an airline seat. A primary function of the invention is to provide the means to improve circulation and tone muscles by exercising the lower body while a user remains stationary. Two particularly inventive aspects of the preferred embodiment of the device are its geometrical shape and the "bounciness," i.e. the restitution rebound characteristics, of its component material. Accordingly, a preferred material for the construction of the exerciser is polyurethane foam.

The device preferably is operated by a gentle "toe-ball-heel" rhythmic treading using alternate feet, by simultaneous feet "pumping" movements that compress and decompress the device, or by simply pressing the feet into the device. According to tests described in detail below, the preferred restitution characteristics of the device has a range of between 0.40 to 0.42 fraction of relative energy absorption, a measurement that corresponds to a restitution rebound that returns optimal energy to the feet, producing a bouncy, energizing workout. Thus, continuous movement and exercise can be maintained, producing a soothing effect on the feet and promoting circulation within the legs.

Thus, it is a primary object of the invention to provide an exerciser and method that allows a user to maintain lower body activity during prolonged periods of sedentary activity.

A further object of the invention is to provide a lower-body exercise device that enhances the posture of a user.

Another object of the invention is to provide a lower-body exerciser that is compact and portable.

Yet another object is to provide a lower-body exercise device with no moving parts that can be manufactured from commonly available and inexpensive materials.

Still another object of the invention is to provide a lower-body exerciser that is simple in design, thus facilitating ease of use.

In accordance with these and other objects, the invention generally provides a compact, three-dimensional platform of material possessing sufficient resilience to allow resistance training.

Various other purposes and advantages of the invention will become clear from its description in the specification that follows. Therefore, to the accomplishment of the objectives described above, this invention includes the features hereinafter illustrated in the drawings, fully described in the detailed description of the preferred embodiments, and particularly pointed out in the claims. However, such drawings and description disclose only some of the various ways in which the invention may be practiced.

DETAILED DESCRIPTION OF THE PREFERRED EMBODIMENTS

The invention relates to a compact platform with no moving parts that possesses resilient qualities such that gentle resistance is encountered by a user applying his or her feet to the platform. Generally, the preferred embodiment is a wedge-like shaped platform of resilient material such as polyurethane foam. More specifically, the preferred device possesses resiliency (i.e. compression/restitution) characteristics that enable a user to perform mild resistance training while in a seated or prostrate position, which tends to promote circulation and other health benefits. Preferably, the resilient means allows compressibility to approximately 30%–60% of the height of the device while returning to the uncompressed state quickly. This provides an optimal energy return or bounce to the feet of the user during exercising, which provides a soothing, toning lower body workout.

Figure 1:
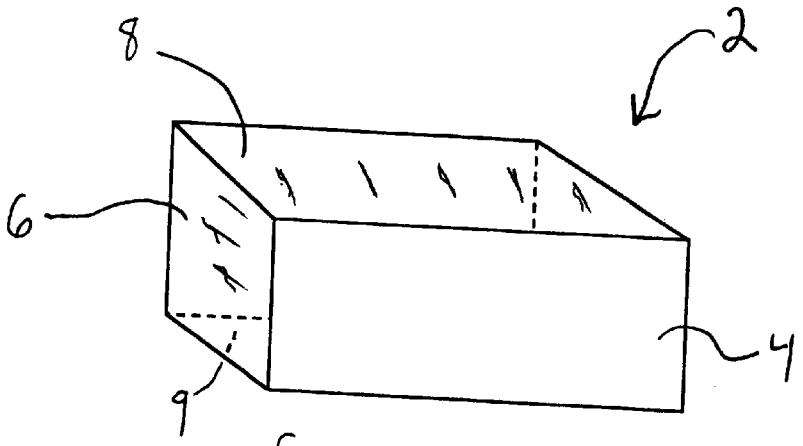
FIG. 1 is a schematic view of a first embodiment of the invention.

As illustrated in FIG. 1, a first embodiment of the inventive exerciser is a three-dimensional rectangular platform 2. The platform 2 possesses two sets of vertical, parallel sidewalls 4 and 6 connected to a top face 8 and a bottom face 9. Preferably, the resilient means of the platform 2 is provided by polyurethane foam having a density of 3.0 lbs/cubic ft, also known as "code 3031" foam (the density is calculated as the mass of a substance divided by the volume, with foam density being expressed in either lbs/cubic ft or kg/cubic meter). The first two digits of the code number 3031 define the density of the foam. Thus, the number 30 refers to 3.0 lbs/cuft. The last 2 digits of the code number (i.e. 31) represent the Indentation Load Deflection (ILD) number as defined by the foam industry. Simply stated, the ILD is a resilience factor and is calculated by the load that is needed to compress or deflect a foam sample with an area of 50 square inches by 25%. Accordingly, the higher the ILD number, the less compressible is the foam.

Figure 2:
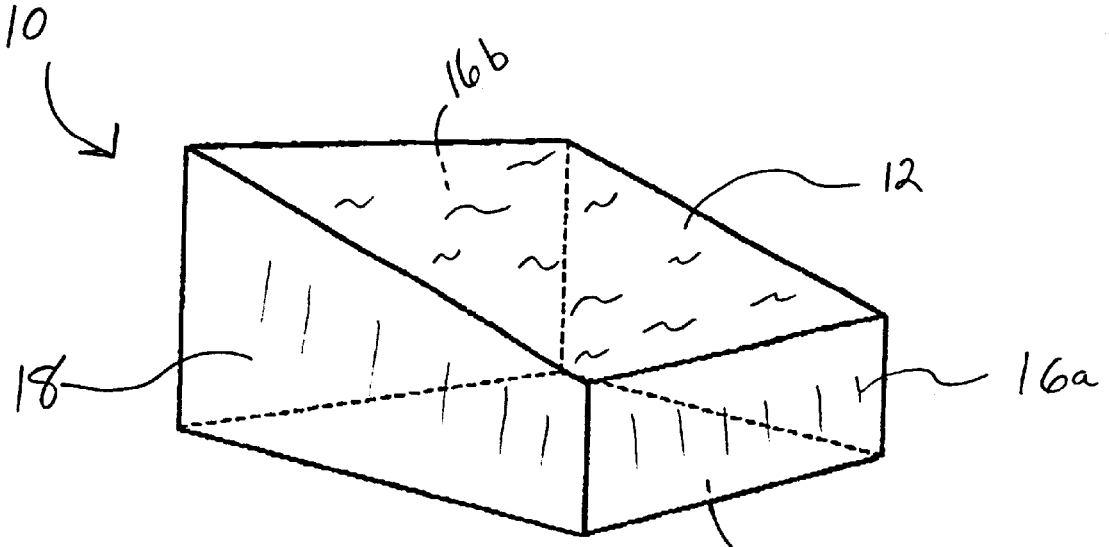
FIG. 2 is a schematic view of a preferred embodiment of the invention.

FIG. 2 shows a preferred exerciser, platform 10. The platform 10 includes a top surface 12 and a bottom surface 14 connected by a first pair of parallel sidewalls, 16*a* and 16*b*, and a second pair of parallel sides walls 18. While sidewalls 18 are identical in shape and size, sidewall 16*a* is shorter than sidewall 16*b*, causing platform 10 to assume a wedge-like shape. The slope of top surface 12 is ideally about 15–17°. However, the slope may be varied during construction or be increased or decreased through the placement of shims or similar devices (not shown) underneath the exerciser to adjust the resistance encountered by a user.

The resiliency of the foam, or equivalent material, enables the feet to be pushed into the device and be supported by the restitution or rebound pressure. One can therefore move the feet up and down and maintain contact with the surface. Moreover, the slope or inclination of the platform enables the difficulty and range of movements to be varied, thus allowing for a greater or lesser amount of work or exercise to be accomplished in a limited space. Accordingly, the invention promotes significant lower body exercise even in the confinements of a seated position.

Figure 3A:
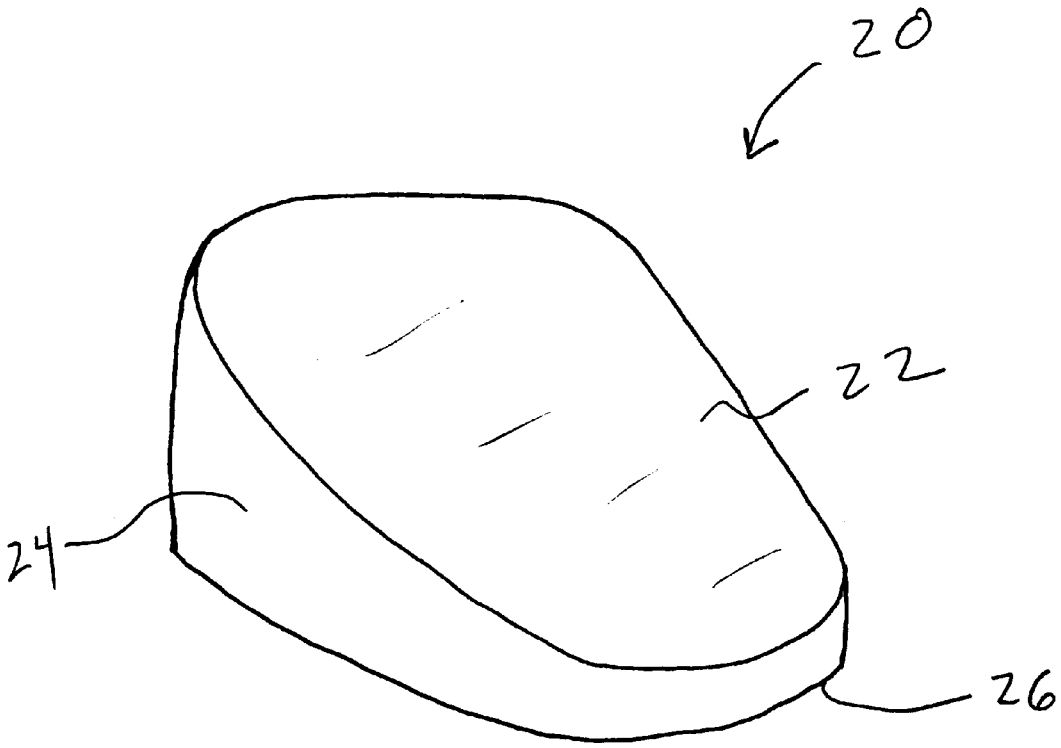
FIGS. 3A and 3B are schematic views of a rounded embodiment of the invention.
Figure 3B:
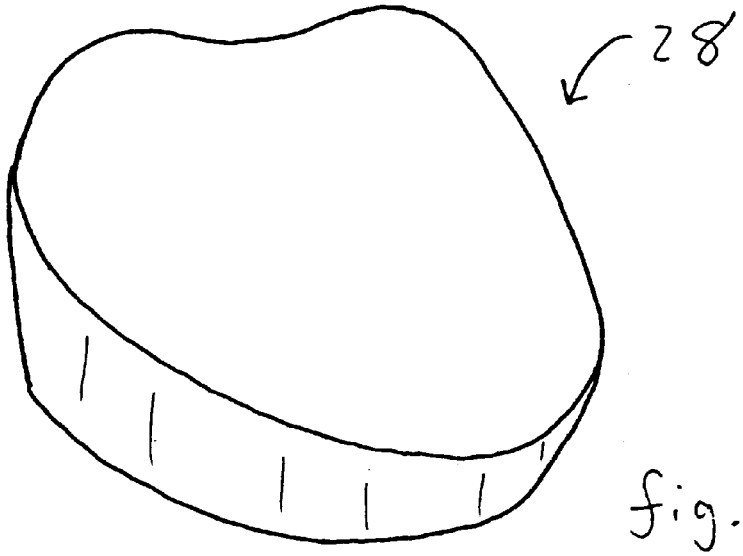

The shape of the exerciser may be varied in accordance with the user's taste and decorative requirements. Turning to FIG. 3A, a rounded platform 20 is shown. Platform 20 includes a sloping top surface 22, a circumferential sidewall 24, and a bottom surface 26. Similarly, FIG. 3*b* shows a rounded heart-shaped platform 28.

The foam embodiments of the invention preferably are compressible by approximately 30%–60% as measured from the original height of the device. Through testing and feedback, the inventor has found that this range gives an ideal amount of resistance for most users. For example, if the rear elevation is 7.75 inches high, the height may be reduced or compressed by 4.41inches (57%) to 3.33 inches. The compressibility of the device can be varied by changing the dimensions or density of the device to accommodate user specifications of age (children and adults), weight, gender, height and foot size so as to keep them within the preferred compressibility range described above.

Figure 4:
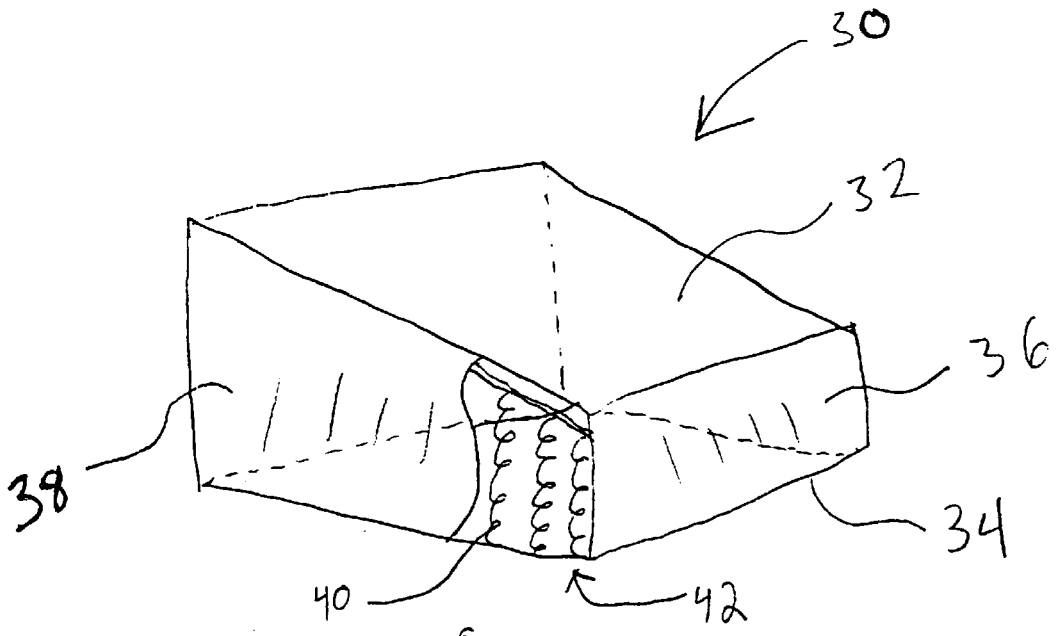
FIG. 4 is a schematic view of an embodiment showing a spring-like resilient means according to the invention.
Figure 5:
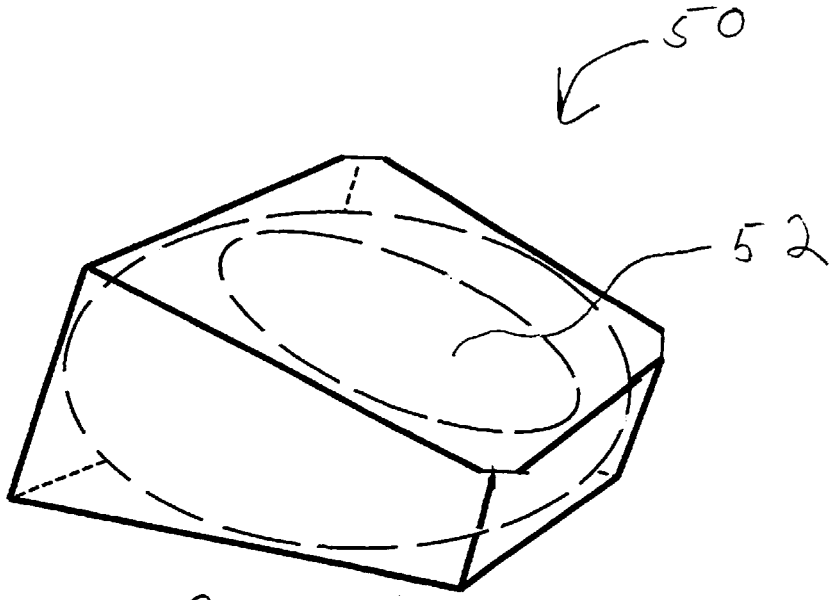
FIG. 5 is a schematic view of an embodiment having a textured top surface.

The material of the invention may be extruded or molded to produce the device shape and bounce characteristics described herein. Of course, the invention may be constructed with resilient materials other than polyurethane foam. Such resilient means for providing resistance may include gels, particles or particulates, springs or other equivalent material to provide the necessary compression and restitution. For example, FIG. 4 illustrates a platform 30 having a sloped top surface 32, a bottom surface 34, and parallel sidewalls 36 and 38. In this case, the resilient means for providing resistance to a force exerted by a user are springs 40 (as seen through cut-away section 42). Alternatively, as shown in FIG. 5, platform 50 may contain an inflated bladder 52 as the resilient means for resisting force applied by a user. Such bladders may be inflated with air, other gases, liquids, fibers, or any other medium that provides resiliency.

Figure 6:
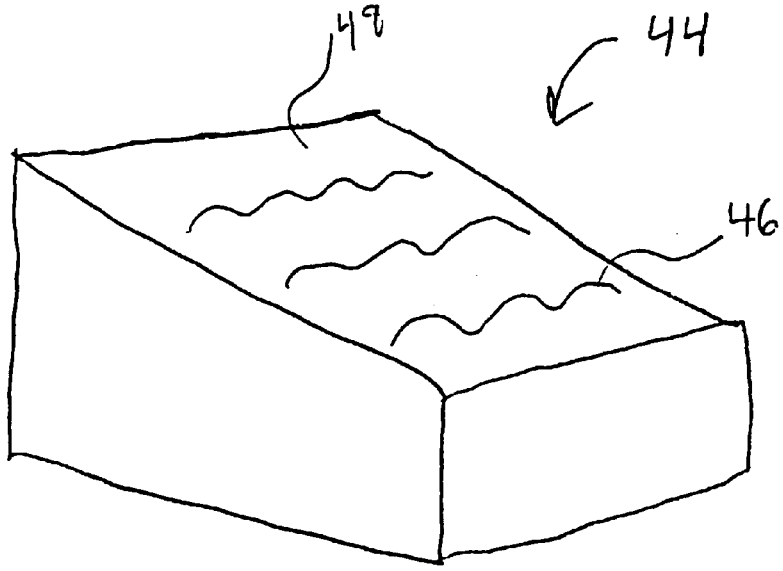
FIG. 6 is a schematic view of an embodiment showing a filled-bladder resilient means according to the invention.

A variety of optional features may be added to the invention. For example, the inventive exerciser may have a textured surface (including shapes such as footprints) as pictured in FIG. 6. In this embodiment, platform 44 simply has a top surface 48 with ridges 46. The ridges 46 provide a means for massaging the feet of a user, and may be arrayed in practically any fashion. Obviously, bumps, studs, and other projections may be used to provide a desired texture to the platforms surfaces.

Figure 7:
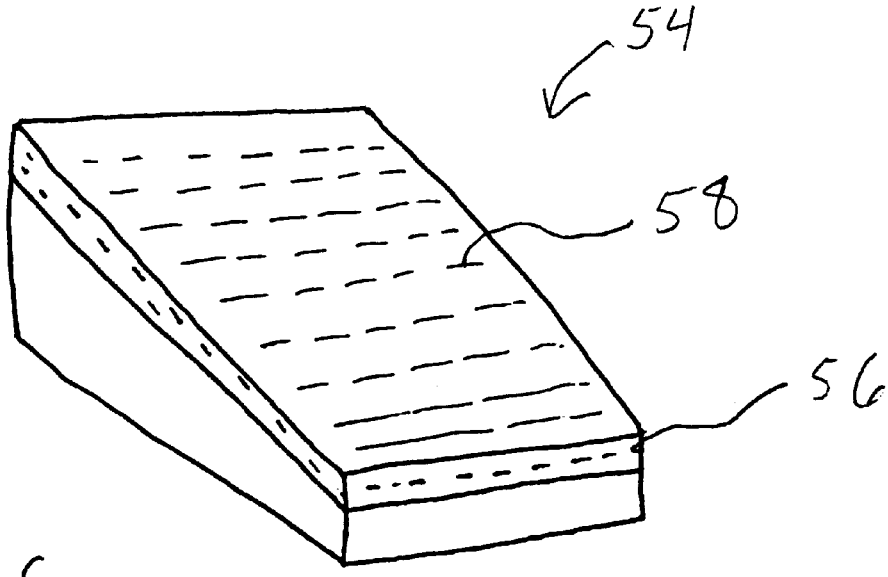
FIG. 7 is a schematic view of an embodiment showing a removable cover, which optionally may contain a thermal layer.

Also optionally, as shown in FIG. 7, the exerciser 54 may be encased by a fabric lining 56 (or by removable cover) constructed from fabric upholstery or other materials such as fleece-like materials, swede or leather. Preferably, the cover is constructed of a machine-washable material so as to facilitate cleaning. Obviously, the exerciser and its liner or cover can be made in a variety of sizes and colors. A thermal layer may also be added either to the surface of the exerciser or to its cover to provide for soothing heat.

The fact that the preferred material for this device is disclosed to be polyurethane foam is based on in-house testing showing it possessed the most satisfactory restitution characteristics. In other words, a novel range of restitution (defined in the following test data) was found to be most satisfying to users based on the amount of resistance and rebound energy provided. In order to quantify the restitution characteristics of the invention, energy impact criterion were measured as follows.

Testing of Resiliency: Measurements of Impact and Restitution

Materials:

The exercise platform was constructed from four different foam densities provided by the two local suppliers, Foam and Fabric (FF) and Whitmark (W). Six individual samples were used in the test.

Apparatus:

An Olympus D460 zoom digital camera, a camera tripod, a 20 inches×30 inches square cardboard grid, a standard lacrosse ball 2.5 inches in diameter, and a cylindrical cardboard chute attached vertically to camera standard were used to provide a drop zone and photographic recordation of the test results.

Method:

The cylindrical cardboard chute was attached to the camera stand by tape and wires. The uppermost edge of the chute measured 65 inches to the floor. The drop height was measured by holding the ball at about its center point inside the chute (1 inch approximately from the upper edge of chute) and allowing it to drop freely through the chute onto the center of the inclined face of the device on the floor surface (6 inches high from the ground), over a distance of 58 inches (65−{6+1})

The ball was dropped several times in order to record a full bounce cycle and at each bounce the ball position was photographed with the cardboard grid in the background. The x and y coordinates of each position of the captured ball images were read off from the grid on the digital photograph and recorded. This procedure was repeated for each of the 6 samples. An algorithm defining the mechanical properties of the bounce of the ball off of the exercise device was developed by a consultant engineer for computer analysis of the data.

Thus, the bounce of the ball was quantified, with the energy impact defining the relative energy absorption and the rebound of the ball defined as the "relative energy return" After numerous test runs and evaluation of the equipment and algorithm, an experiment was performed from which the results are shown in Table 1.

Results:

TABLE 1

Relative energy absorption and rebound values of different foam densities of device.

| Sample Number | Foam Density Samples | Relative Energy Absorption | Relative Energy Return |
|---|---|---|---|
| 1 | 3031(FF) | 0.412367 | 0.587633 |
| 2 | 3031(W) | 0.415344 | 0.584656 |
| 3 | 1833(W) | 0.460155 | 0.539845 |
| 4 | 2511(FF) | 0.466062 | 0.533938 |
| 5 | 2511(W) | 0.455716 | 0.544284 |
| 6 | 1826(W) | 0.418690 | 0.581310 |

Discussion:

The device constructed from Foam 3031(FF) and 3031 (W) had the highest relative energy return fractions (0.587633 and 0.584656) and least relative energy absorption fractions (0.412367 and 0.415344), producing what was objectively determined by users to provide the best combination of resistance and restitution energy to the feet and legs. Also preferred was Foam 1826, with a relative energy return fraction of 0.581310 and relative energy absorption fraction of 0.418690.

Foam samples 2511 and 1833 had higher than 0.42 energy absorption fractions and were not as preferred in this instance. The results of this test indicate that the preferred restitution (relative energy return) ranges between 0.53 to 0.59 because these values correspond to the level of resistance/restitution preferred by test users.

Methods of Exercise

Figure 8:
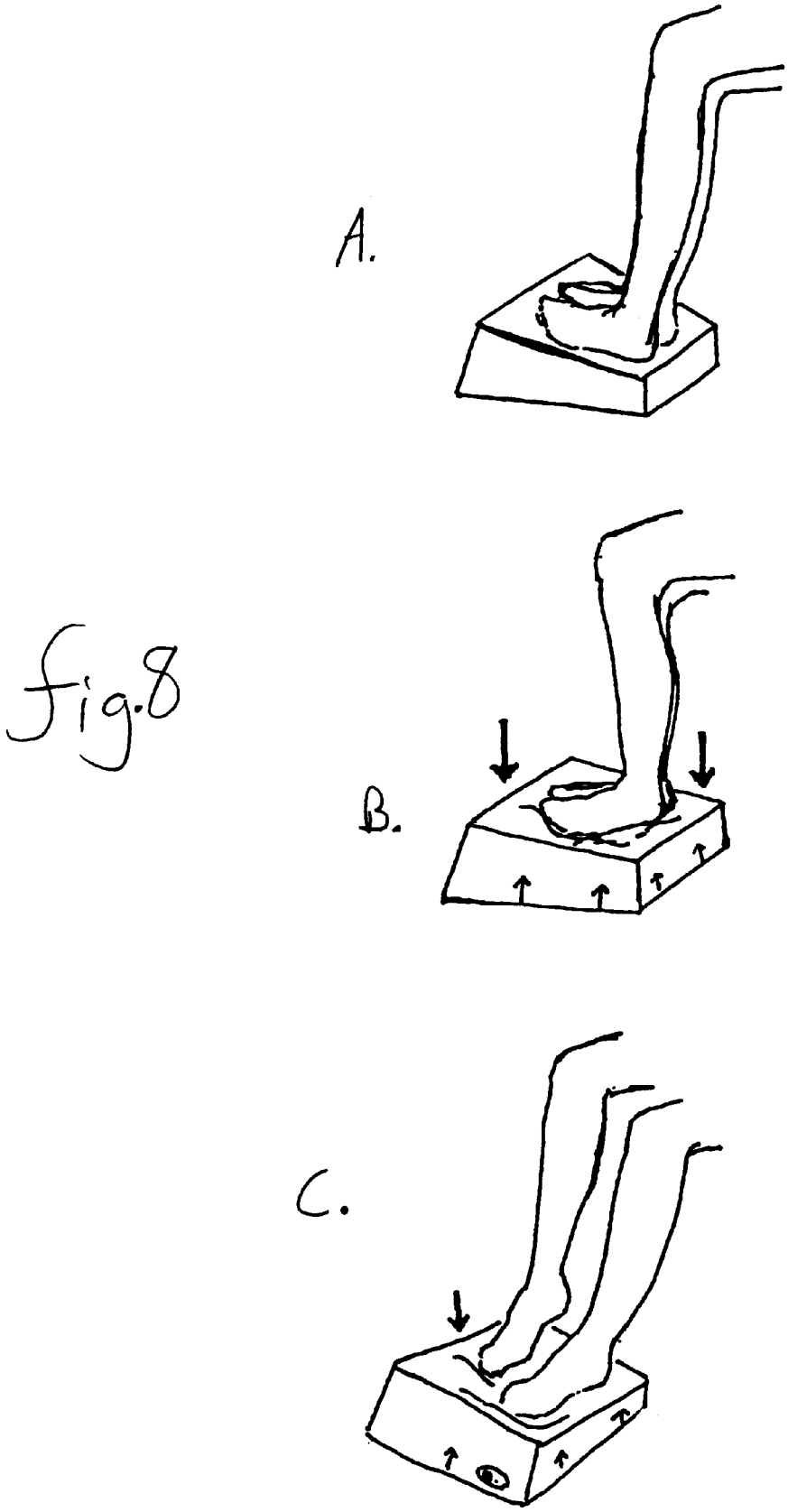
FIG. 8 is a schematic view illustrating the preferred exercise method of the invention.

While one will find that many methods of use will result in exercise benefits, the preferred method will now be described. Turning to FIG. 8A, the exerciser is placed in position near the legs so that the feet of the user can be placed comfortably on the top surface as shown. Both feet are placed parallel, comfortably apart, resting on this upper, inclined surface. There are a variety of movements which can promote exercise of the lower body parts:

1. Each foot can be gently pressed in an alternating fashion in a "toe-ball-heel" movement into the spongy surface, compressing the device with a treading-like rhythm The knees are maintained at approximately right angles to the thighs and the back is maintained supported and upright for maximum thrust into the device. These movements are produced by contraction and relaxation of muscles in the lower hips, thighs, lower abdomen, calves including other leg muscles, which produce toning of the muscles. Contraction and relaxation of the calf muscles and other leg muscles activate the skeletal pump mechanism enhancing circulation in the lower limbs. These and the other movements described below can be maintained for a number of repetitions or length of time, for example, 1–3 minutes, according to the needs and capability of the user.
2. Sitting upright with back supported, knees at approximately right angles to the thighs, both feet are gently pressed simultaneously down and up in a pumping-like motion. A fast or slow rhythm can be maintained, according to the needs of the user. This movement enables strong contraction and relaxation of the thighs and buttocks, promoting toning and circulation.
3. Sitting upright with back supported, knees bent, alternate feet are pressed into the surface, pointing the toes forward and down and extending the foot, followed by pressing of the heel into the surface and flexing the foot with the toes pointing upwards. Rhythmic movement can be produced by alternating the feet which result in a pedaling-like motion. Alternatively, both feet can be moved simultaneously, producing a back and forth rocking movement. These movements massage the feet and promote contraction and relaxation of the leg muscles, energizing the legs and ankles and stimulating circulation.
4. Sitting upright with back supported, knees bent the feet are pressed into the device alternately. These movements contract and relax the thigh, calf, gluteal, and lower hip muscles, promoting toning and circulation of the lower limbs.
5. Sitting upright with back supported, both feet on the surface, the toes are gently moved to grip the fabric with gentle manipulation of the bouncy surface. Repetitions of these movements promote strengthening of the muscles and ligaments of the ankles and arches.
6. The exerciser may be turned around (180°) so that the feet are placed pointing downwards on the declining slope. Exercises as preferred may be repeated in this position so as to work the muscles in an opposite fashion thus reducing muscle stress and producing relaxation.

As would be understood by those skilled in the art, any number of functional equivalents may exist in lieu of the preferred embodiments described above. Thus, as will be apparent to those skilled in the art, changes in the details and materials that have been described may be within the principles and scope of the invention illustrated herein and defined in the appended claims.

Accordingly, while the present invention has been shown and described in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent products and methods.

For example, there is a range of sizes designed for office and home use and for air travel. There are soft and firm consistencies. An extra small size is designed for convenient carrying and use on an airplane and may include an attached vinyl slipcover for optional use with shoes. Most sizes can be conveniently stuffed in a specifically designed stuff sack for travel.

Some size dimensions (in inches) of the foam-constructed device include:

Standard: 8×4×12×10

Standard/Soft: 8×4×12×10

Large: 8×4×12×12

Extra large/Soft: 8×4×10×15.5

Extra large: 6.5×3.5×10×15.5

Small: 6×3×10×12

Extra small: 5×3×6.5×11 or 5×3×6.5×10 or 5×3×6.5×12

Possible size dimensions of the inflatable forms of the device:

Length=12–15.5 inches

Width at widest parts=6–10 inches

Depth=24 inches.

The exerciser can also be used to work the upper limbs and chest areas by compressing the foam with the hands in a pumping or press-up motion when the device is on a table or on the floor. Further upper body exercises can be performed with the device placed on the knees while sitting and pushing the sides of the device simultaneously in and out with the hands. Modifications of the rectangular prism on a trapezoidal base shape to a small rectangular prism shape can produce a device specifically for exercising the upper and lower arm, upper chest and back areas while sitting. This is particularly useful when traveling long distance in an airplane. The confined space is unsuitable for working out by means of conventional flex stretching devices. By holding the opposite sides of the rectangular prism shape with both hands placed in front of the body, and pushing in and out simultaneously with both hands to compress and decompress the foam laterally, resistance exercise of the upper limbs, chest and back can be achieved, improving muscle tone and circulation while sitting in a confined space.

I claim:

1. A method of exercising the limbs of a seated user, comprising the steps of:

a. providing a three-dimensional platform, said platform having a top surface connected to a bottom surface by a resilient means for providing resistance to a pushing force applied by a user, wherein said resilient means provides a relative energy return of between 0.53 and 0.59, b. positioning a limb of a seated user upon the top surface; and c. treading the limb upon the top surface such that cycles of compression and restitution are achieved.

2. The method of claim 1, wherein the platform is sized to fit in the space provided underneath an airline seat.

3. The method of claim 1, wherein the resilient means comprises polyurethane foam.

4. The method of claim 1, wherein the platform comprises a single member with no moving components.

5. The method of claim 1, wherein the device is reversibly compressible to approximately 30–60% of an uncompressed height of the device.

6. The method of claim 1, wherein the top surface of the platform is sloped.

7. The method of claim 1, wherein the platform further comprises a top surface and a bottom surface connected by two sets of opposing, parallel sidewalls.

8. The method of claim 7, wherein the top surface of the platform is sloped.

* * * * *